US005644983A

United States Patent [19]

Herrmann et al.

[11] Patent Number: 5,644,983

[45] Date of Patent: Jul. 8, 1997

[54] COUPLING ARRANGEMENT FOR COUPLING PRINTING STANDS TO ONE ANOTHER IN A PRINTING PRESS AND METHOD FOR COUPLING PRINTING STANDS TO ONE ANOTHER IN A PRINTING PRESS

[75] Inventors: Bernd Herrmann, Malsch; Hans-Jürgen Kusch, Neckargemünd, both of Germany

[73] Assignee: Heidelberger Druckmaschinen Aktiengesellschaft, Heidelberg, Germany

[21] Appl. No.: 562,221

[22] Filed: Nov. 28, 1995

[30] Foreign Application Priority Data

Nov. 28, 1994 [DE] Germany ..... 44 42 279.2

[51] Int. Cl.[6] ..... B41F 7/02

[52] U.S. Cl. ..... 101/218; 101/247; 101/182

[58] Field of Search ..... 101/485, 247, 101/218, 181, 177, 137, 139, 140, 144, 145, 182, 184, 185

[56] References Cited

U.S. PATENT DOCUMENTS

| | | | |
|---|---|---|---|
| 2,258,653 | 10/1941 | Klingelfuss | 101/247 |
| 2,689,524 | 9/1954 | Wood | 101/218 |
| 2,690,121 | 9/1954 | Auerbacher et al. | 101/181 |
| 3,076,407 | 2/1963 | Zimmerman | 101/218 |
| 4,369,705 | 1/1983 | Gelinas | 101/177 |
| 4,889,051 | 12/1989 | Sarda | 101/177 |
| 5,031,532 | 7/1991 | Walther | 101/247 |

FOREIGN PATENT DOCUMENTS

| | | |
|---|---|---|
| 0297118 | 1/1992 | Germany . |
| 0297117 | 1/1992 | Germany . |
| 4142792 | 6/1993 | Germany . |

*Primary Examiner*—Eugene H. Eickholt

*Attorney, Agent, or Firm*—Nils H. Ljungman and Associates

[57] ABSTRACT

A device for the coupling and uncoupling of a printing unit, said printing unit, with its plate cylinder, being engaged with a blanket cylinder in a first position and being disengaged from said blanket cylinder in a second position. Further, the device can be configured so as to additionally serve for a printing press, having at least two printing units assigned to one blanket cylinder, to be variably operated with optimal results. This is achieved in that the printing unit can be brought into a third position, wherein it is disconnected from the drive. Also contemplated herein is a method for coupling printing stands to one another in a printing press.

20 Claims, 3 Drawing Sheets

COUPLING ARRANGEMENT FOR COUPLING PRINTING STANDS TO ONE ANOTHER IN A PRINTING PRESS AND METHOD FOR COUPLING PRINTING STANDS TO ONE ANOTHER IN A PRINTING PRESS

BACKGROUND OF THE INVENTION

1. Field of the Invention

The present invention generally relates to a device for the coupling of a printing unit, whereby, in a first position, the printing unit, with its plate cylinder, is engaged with a blanket cylinder and, in a second position, the printing unit is disengaged from the blanket cylinder.

2. Background Information

From German Patent No. 41 42 792 A1, there is known a device in which a toggle lever is brought into a stretched position by means of a pneumatic cylinder. In turn, the toggle lever is hinged to a rocker arm, with the plate cylinder being mounted on the rocker arm. This construction allows for the plate cylinder to be brought into two positions, namely, into the position where it is engaged with the blanket cylinder and into a second position where it is disengaged from the blanket cylinder. This system is usually adequate when it is merely for the purpose of engaging plate cylinders with the blanket cylinder before the start of a printing operation and disengaging them again after the end of a printing operation, in order to perform a plate change.

However, there appears to exist the need, in the case of a printing press having a plurality of printing units assigned to one blanket cylinder, to equip the printing press so as to be variable in such a way that the printing press can be optimally operated with a random number of its printing units. The result would be a maximal reduction of material wear and driving power.

OBJECT OF THE INVENTION

It is an object of the present invention to further develop a device of the above-mentioned type for a printing press in such a manner that the device serves, for a printing press in which at least two printing units are assigned to one blanket cylinder, to be optimally and variably operable.

SUMMARY OF THE INVENTION

The above object is achieved, in accordance with at least one preferred embodiment of the present invention, in that a printing unit can be brought into a third position, wherein it is uncoupled from the drive mechanism.

The present invention allows for a printing press to be operated with those printing units which are needed at a given time, without the non-printing units being driven. Thus, there is essentially no wear on such non-printing units, and there is less demand on the drive mechanism. Consequently, power consumption is reduced and the printing speed can be increased.

One embodiment of the invention provides that the plate cylinder of a single coupleable/uncoupleable printing unit, or the plate cylinder of several such printing units, rotates about a shaft which is rotatably and concentrically mounted in the frame of a printing unit, with the shaft having eccentrics at the end regions thereof. The eccentrics have couples mounted thereon, the couples are in contact with the blanket cylinder, and the three positions of the printing unit correspond to three different angular positions of the eccentrics. The couples may be connected with the shaft of the blanket cylinder either directly or via the frame on which the blanket cylinder is mounted.

Through adjustment by means of eccentrics arranged at the ends of the plate cylinder shaft, a virtually absolutely parallel and accurate positioning of the plate cylinder can be ensured. This is especially advantageous at the start of a printing operation of the printing unit, because it is desirable for the printing pressure on the entire contact line between plate cylinder and blanket cylinder to be accurately maintained. Additionally, this bearing arrangement with eccentrics and couples tends to be extremely stable and can ensure a machine run virtually free of vibrations, such vibration-free running usually being mandatory for precision printing.

The coupleable/uncoupleable printing unit, together with the plate cylinder, can preferably be moved into three different positions. This can be realized by having the printing unit displaceably mounted or, as proposed in a further embodiment, by attaching the printing unit to the machine frame on which the blanket cylinder is mounted, by means of a pivot arranged above the coupling links. This pivot also ensures high stability; particularly, in the coupled state of the printing unit, it allows accurate positioning of the printing unit, whereby uniform printing pressure is achieved.

As the eccentrics are preferably fixedly connected to the shaft and are displaceable by means of a common drive, a simple drive is feasible and parallelism of the displacement can be ensured.

The displacement of the eccentrics can be realized in various ways; for example, the shaft can be shifted by means of a worm gear, or, as proposed in one exemplary embodiment, the displacement of the eccentrics can take place by means of a toggle lever mechanism. The actuation of this toggle lever mechanism, or alternatively another mechanism for displacing the eccentrics, can take place via a pneumatic cylinder. The use of a pneumatic cylinder tends to be advantageous, as compared to a hydraulic cylinder, because the air pressure control system, which is usually present in the machine anyhow, can be utilized.

In accordance with at least one preferred embodiment of the present invention, the movement of a printing unit into the three positions can take place through the drive mechanism, or the drive mechanism could only serve for the engagement and disengagement of the plate cylinder, while the uncoupling of the printing unit can be performed through a manual operation. By such further development, the result is that the adjusting path for the mechanism actuated by the drive mechanism does not have to be very large, so that a more simple construction is feasible, and that a large adjusting path for uncoupling can be realized in simple manner by means of the manual operation. This can be achieved, for example, by swivellably hinging the pneumatic cylinder to the frame of the printing unit, securing the pneumatic cylinder for the coupling/uncoupling process, and releasing the securement when a manual operation is performed. Thus, for manual operation, the pneumatic cylinder, together with the mechanism arranged between it and the eccentric, can be swivelled along according to the adjusting path. Consequently, there is essentially no longer any need for designing the mechanism and the pneumatic cylinder for such a large adjusting path.

A suitable embodiment provides that, for the uncoupling of the printing unit, the eccentrics, through manual operation, are displaced beyond a dead center, until the toggle lever mechanism butts against a stop. In this way, a self-holding or self-securing mechanism is realized which does not require individual securement and which remains in its position, even with the machine running and vibrations emanating therefrom.

It is advantageous that the manual operation be able to be performed only when the plate cylinder is in a position of being secured against displacement. In this way, it is ensured that coupling of the printing unit takes place in the same position in which it is uncoupled. Thus, even though the machine at large is brought back into the position where it was before the uncoupling of the printing unit, register accuracy is upheld. This reduces the make-ready time for the following printing operation, as merely a readjustment in the context of the newly mounted printing plate is sufficient. This readjustment takes place within the displacement range of the adjustment device for plate change; adjustment to a greater extent would essentially not be possible or only at considerable expenditure.

The securement of the plate cylinder in the position for uncoupling and coupling the printing unit can be achieved by providing a fixing bolt that is insertable into a bore of the plate cylinder. The guarantee for such a register-true coupling of the printing unit to the printing press is found in that, upon pressing a button, the printing press, by means of control, is brought into the position for inserting the fixing bolt, and only in this position will a safety flap be opened and an operator's tool be able to be inserted. Furthermore, through the insertion of the operator's tool, the insertion of the fixing bolt and the release of the securement of the pneumatic cylinder preferably takes place. In this manner, safety is ensured in the right position and unwanted displacement is essentially not possible.

In one exemplary embodiment, for this purpose, there is a lever of a control shaft that extends into the insert path of the operator's tool which, while being inserted, pushes the lever aside, such that the control shaft rotates and, via a gearing, causes the fixing bolt to be inserted and a latch to be moved out of its plate cylinder-locking position. Through a rotary motion of the shaft of the plate cylinder by means of the operator's tool, the eccentrics are then displaceable beyond the dead center and back again, whereby the uncoupling and coupling of the printing unit from and to the drive mechanism takes place.

Operating safety can further be increased by detecting the completion of a displacement of a printing unit, into one of its positions, with a limit switch, so that the printing press is cleared again for operation only after such a position has been reached. In order that no displacement can be carried out with the operator's tool during printing, it is contemplated herein that, after the respective positioning has been carried out by means of the operator's tool, and after removal of the operator's tool, the entry opening for the operator's tool is closed by a safety flap.

A further embodiment of the invention provides that a securing bolt, being attached to a swivellable plate through which the pneumatic cylinder is swivellably mounted on a frame, moves under the latch while the securement is released, thereby holding the control shaft in its position for the uncoupling of the printing unit. In this manner, the mechanism which inserts the fixing bolt for securing the plate cylinder is self-lockingly held, and this securement is not released by removing the operator's tool.

Coupling of the printing unit in the correct machine position can be achieved in that, for coupling of the uncoupled printing unit, the printing press, upon pushing a button, is brought into a position in which the register of the machine at large corresponds with the register of the printing unit to be coupled, and only then does the safety flap move open.

For the releasing of the above-described self-locking securement, it is contemplated herein that, for the coupling of the printing unit by means of an inserted operator's tool, the eccentrics be displaceable in a manner in which the toggle lever mechanism moves into a position wherein the pneumatic cylinder, upon the releasing of the latch through the securing bolt, is swivelled back into its secured position and simultaneously the printing unit is coupled to the drive. Then, the self-locking securement can be released. For this purpose, it is suggested that, through the removal of the operator's tool, the lever with the control shaft swivels again into the insert path of the operator's tool via a spring which moves the fixing bolt outward, and through this swiveling motion of the control shaft, the latch is moved into its securing position again.

In this way, it is ensured that the insertion of the operator's tool for the coupling of the printing unit is necessarily associated with securing the plate cylinder against displacement, so that an uncoupling of the printing unit is only possible when the plate cylinder rests in its correct position. The securement of the plate cylinder preferably is released when the printing unit uncoupled from the drive mechanism is coupled again, for example, when the gear wheels of this printing unit engage again in the gear wheel train of driving gear wheels of the printing press.

For practical reasons, it is contemplated herein that a spring be provided to support the moving away of the printing unit. This allows a more simple design of the pneumatic cylinder and the mechanism, and carrying out the displacement by manual operation will require less energy and expenditure.

The coupleable/uncoupleable printing units may be constituted by two or more printing units of equal design which all are assigned to one blanket cylinder, or a printing press with a main printing unit which is always engaged with the blanket cylinder and whereto an additional printing unit can be coupled.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

In summary, one aspect of the invention resides broadly in a method of coupling printing stands to one another in a printing press, the method comprising the steps of: providing a printing stand; the step of providing a printing stand comprising the step of providing a plate cylinder; providing a blanket cylinder; providing a drive mechanism for rotationally driving at least the blanket cylinder; providing means, being selectively engageable with the drive mechanism, for driving the plate cylinder; providing means for selectively positioning at least a portion of the printing stand with respect to the blanket cylinder, the means for selectively positioning comprising means for establishing: a first position, wherein the printing plate makes contact with the blanket cylinder; a second position, wherein the printing plate is positioned out of contact with the blanket cylinder and the means for driving the plate cylinder is engaged with the drive mechanism; and a third position, wherein the printing plate is positioned out of contact with the blanket cylinder and the means for driving the plate cylinder is disengaged from the drive mechanism; the method further comprising the additional steps of: initiating a first operation of the printing press; contacting the plate cylinder with the blanket cylinder by establishing the first position with the means for selectively positioning; maintaining contact between the plate cylinder and the blanket cylinder during the first operation of the printing press; completing the first operation of the printing press; bringing the plate cylinder out of contact with the blanket cylinder by establishing the second position with the means for selectively positioning; maintaining the plate cylinder out of contact from the blanket cylinder, and simultaneously maintaining engagement of the means for driving the plate cylinder with the drive mechanism, subsequent to completion of the first operation of the printing press; prior to initiating a second, subsequent operation of the printing press, bringing the means for driving the plate cylinder out of engagement with the drive mechanism by establishing the third position with the means for selectively positioning; thereafter initiating the second, subsequent operation of the printing press; and maintaining the means for driving the plate cylinder out of engagement with the drive mechanism during the second operation of said printing press.

BRIEF DESCRIPTION OF THE DRAWINGS

The invention will be best understood upon reading the following description of preferred embodiments in view of the accompanying drawings, wherein.

DESCRIPTION OF THE PREFERRED EMBODIMENTS

Figure 1:
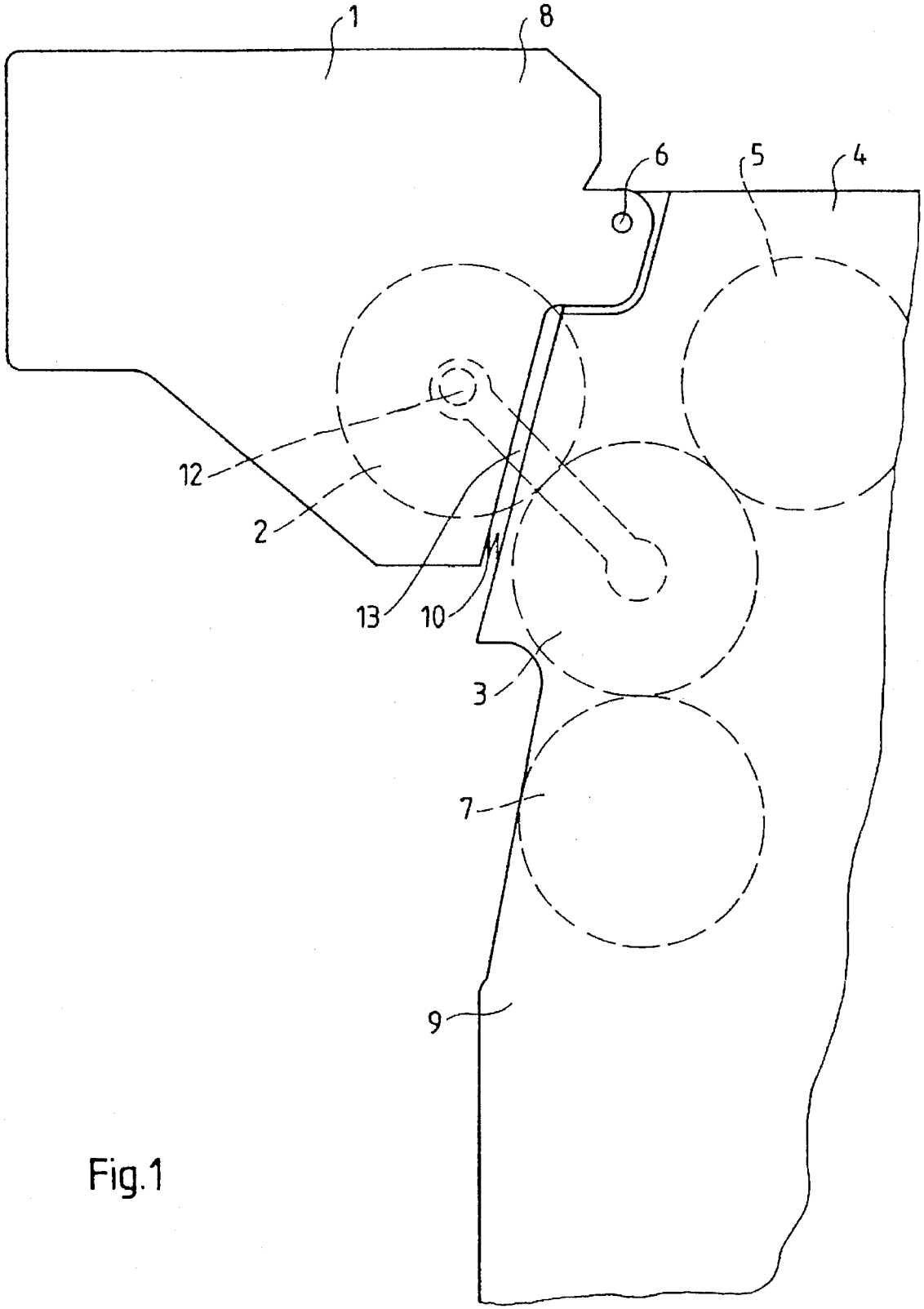
FIG. 1 is a schematic view of a printing press with a coupleable printing unit.

FIG. 1 represents an exemplary embodiment of the invention and is a schematic illustration of a printing press with one coupleable printing unit 1. An additional printing unit 4 or a number of printing units assigned to a blanket cylinder 3 may be equipped in like manner, so as to be coupleable. For the coupling device in the exemplary embodiment presented by FIG. 1, the additional printing unit 4 with its plate cylinder 5 is merely schematically indicated.

The printing unit 1 is preferably attached to a machine frame 9 by means of a pivot 6, with a blanket cylinder 3 being mounted in the machine frame 9. The printing unit 1 is designed as a coupleable and uncoupleable printing unit 1. The plate cylinder 2 of the printing unit 1 rotates around a shaft 11 which is centrally mounted in a frame 8. The shaft 11 (see FIG. 3) preferably has eccentrics 12 in its end regions, and couples 13 are preferably mounted in the eccentrics 12, with the couples 13 being connected with the blanket cylinder 3. The couples 13 may be connected with the shaft of the blanket cylinder 3 directly, or they may be connected with the blanket cylinder 3 in a different way, for example, via the machine frame 9.

Through rotation of the shaft 11, various distances between the plate cylinder 2 and the blanket cylinder 3 can be set via the eccentrics 12 and the couples 13. Thereby, three positions for the printing unit 1 to adopt can be established, namely: a first position, wherein the plate cylinder 2 is engaged with the blanket cylinder 3; a second position, wherein the plate cylinder 2 is disengaged from the blanket cylinder 3; and a third position, wherein the printing unit 1 is uncoupled from the drive mechanism of the printing press. In this uncoupled state, for example, the gear wheels of the printing unit 1 can be disengaged from the gear wheel train of driving gear wheels which drive the blanket cylinder 3. The three positions, which correspond with three different distances between the plate cylinder 2 and the blanket cylinder 3, are preferably reached through three different angular positions of the eccentrics 12. For this purpose, the eccentrics 12 are preferably rotated. For practical reasons, the eccentrics 12 are preferably fixedly connected with respect to the shaft 11 which serves as a support for the plate cylinder 2; thus, the eccentrics 12 can be displaced simultaneously through s rotation of the shaft 11. Such displacements may be performed manually or automatically, whereby various mechanical embodiments are feasible.

Thus, in accordance with at least one preferred embodiment of the present invention, printing unit 1 will preferably be positionable between three different positions, with respect to blanket cylinder 3. In a first position, plate cylinder 2 will preferably be in driving and mutually contacting engagement with respect to the blanket cylinder 3. In a second position, the plate cylinder 2 will preferably be out of contacting engagement with the blanket cylinder 3 but will preferably still be in driving engagement with respect to the blanket cylinder 3. Finally, in a third position, the printing unit 1 will preferably be out of driving engagement with the blanket cylinder 3. That is, in the third position, plate cylinder 2 will preferably be both out of mutually contacting engagement with the blanket cylinder 3 and also out of driving engagement with respect to blanket cylinder 3.

The uncoupling of a driving engagement between plate cylinder 2 and blanket cylinder 3 can conceivably assume any of a number of different forms, according to the driving scheme being utilized in the printing press in question. For example, in this embodiment, in a conventional manner, an arrangement of gear wheels are used to drive cylinders such as blanket cylinder 3 and plate cylinder 2, the uncoupling of driving engagement contemplated herein with respect to the aforementioned third position can preferably be accomplished by removing such driving gear wheels out of mesh with respect to one another.

It will be understood, then, that, with regard to the second position, it is contemplated that, even though the plate cylinder 2 and blanket cylinder 3 would be out of mutually contacting engagement with respect to one another, one or more of the rollers and cylinders associated with printing unit 1, including plate cylinder 2, would still be rotating, even though there would be essentially no capability of ink transfer between plate cylinder 2 and blanket cylinder 3. In contrast, in the aforementioned third position, the rollers and cylinders associated with the printing unit 1, including plate cylinder 2, will not be rotating at all, even during rotation of blanket cylinder 3.

FIG. 1 also shows the additional printing unit 4 with a plate cylinder 5 above the blanket cylinder 3 and an impression cylinder 7 below the blanket cylinder 3. Via a spring 10, the printing unit 1 can be displaced with less energy and, consequently, with less mechanical facilities.

Figure 2:
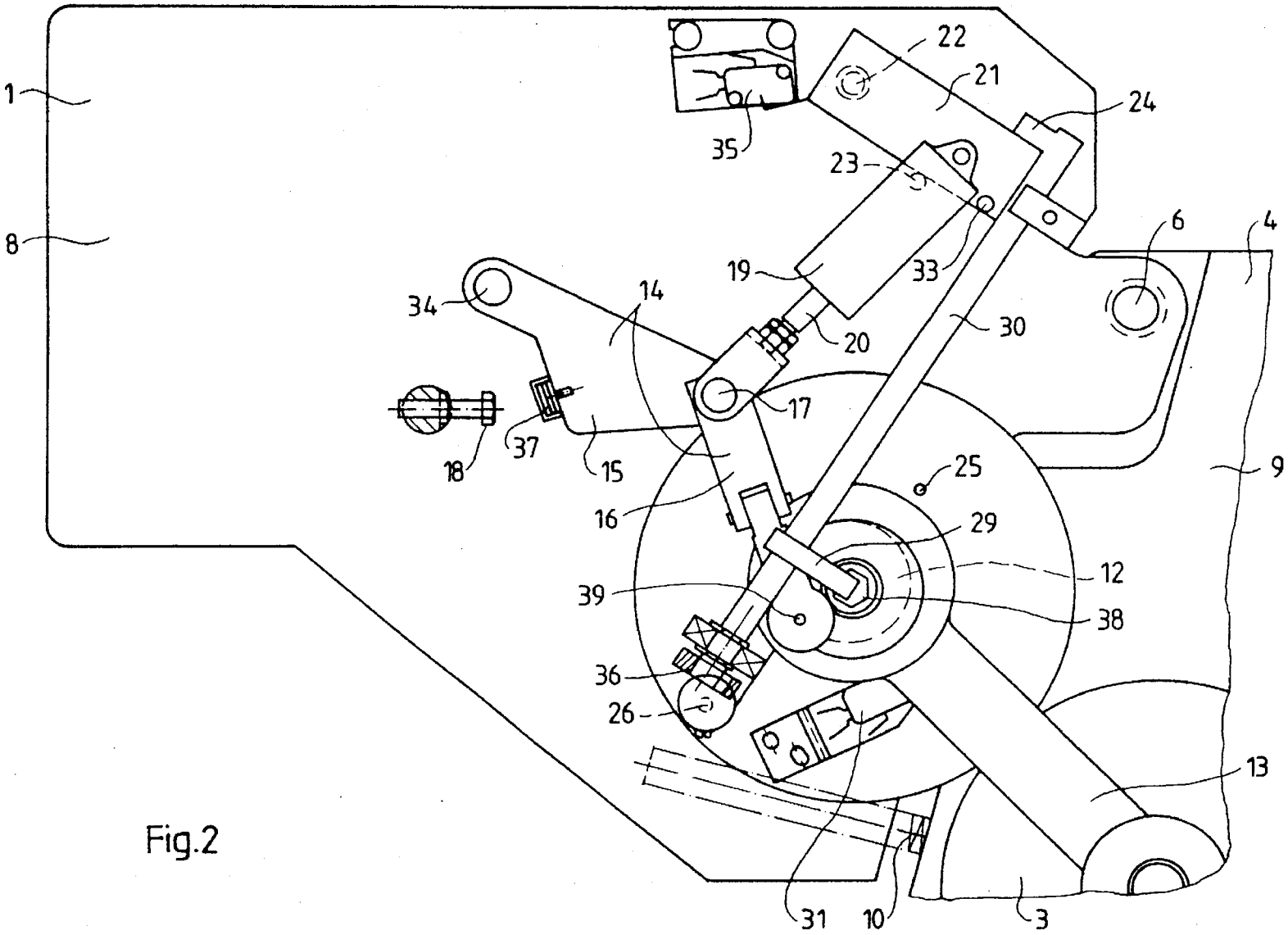
FIG. 2 is e detailed view of an embodiment of a coupleable printing unit.

FIG. 2 shows the details of one embodiment of a coupleable printing unit 1. The same reference numerals as in FIG. 1 are used for the parts end functions as already described hereinabove.

FIG. 2 additionally shows a drive mechanism for the displacement of the eccentrics 12, whereby the printing unit 1 is brought into the positions described above. FIG. 2 particularly shows the second position of the printing unit 1, wherein the plate cylinder 2 is disengaged from the blanket cylinder 3, with the printing unit 1 still being coupled to the drive mechanism. The drive mechanism is not shown in FIG. 2; the coupling preferably takes place in that gear wheels of printing unit 1 are in engagement with a gear wheel train of driving gear wheels of the printing press.

In accordance with at least one preferred embodiment of the present invention, the feature for carrying out the displacement of the eccentrics 12 is a toggle lever mechanism 14 that includes a lever 15 mounted to the frame 8 and a lever 16 mounted on the eccentric 12. These levers 15, 16 are preferably connected with one another via a toggle lever joint 17. The bearing of the lever 15 in the frame 8 is indicated at 34, and the bearing of the lever 16 on the eccentric 12 is indicated at 39. The toggle lever mechanism 14 is preferably actuated via a pneumatic cylinder 19 which is mounted in the frame 8. With a piston rod 20 of the pneumatic cylinder 19 engaging in the toggle lever joint 17, the toggle lever mechanism 14 can be moved from the angled position (as shown in the drawing) into a stretched position, wherein a spring element 37 of the lever 15 butts against a stop 18 of the frame 8. In this position, the plate cylinder 2 is engaged with the blanket cylinder 3.

Thus, in accordance with a preferred embodiment of present invention, pneumatic cylinder 19, with piston rod 20, may preferably be provided, in association with toggle lever mechanism 14, in order to affect the establishment of two different positions of the plate cylinder 2 with respect to blanket cylinder 3. Accordingly, in an unstretched position of piston rod 20, as shown in FIG. 2, the plate cylinder 2 will preferably be out of contacting engagement with respect to blanket cylinder 3. This could essentially correspond to the "second" position discussed further above. Consequently, upon extension of piston rod 20, toggle lever mechanism 14 can preferably traverse from a bent orientation, as shown in FIG. 2, to a comparatively straightened orientation. This straightening of toggle lever mechanism 14, which conceivably will involve the provision of an increased angle of levers 15 and 16 with respect to one another upon extension of piston rod 20, can preferably be limited by an appropriate arrangement such as the spring element 37 in combination with stop 18, as shown in FIG. 2. This comparatively straightened orientation of toggle lever mechanism 14, then, could essentially correspond to the "first" position discussed further above.

It will be understood that the actual translational displacement of the plate cylinder 2 with respect to blanket cylinder 3 can be affected upon rotation of eccentric 12, via an initial linear motion imparted by lever 16 to eccentric 12 via bearing 39.

In this exemplary embodiment, then, the printing unit 1 can be moved into two positions through the driving action caused by the pneumatic cylinder 19.

Figure 3:
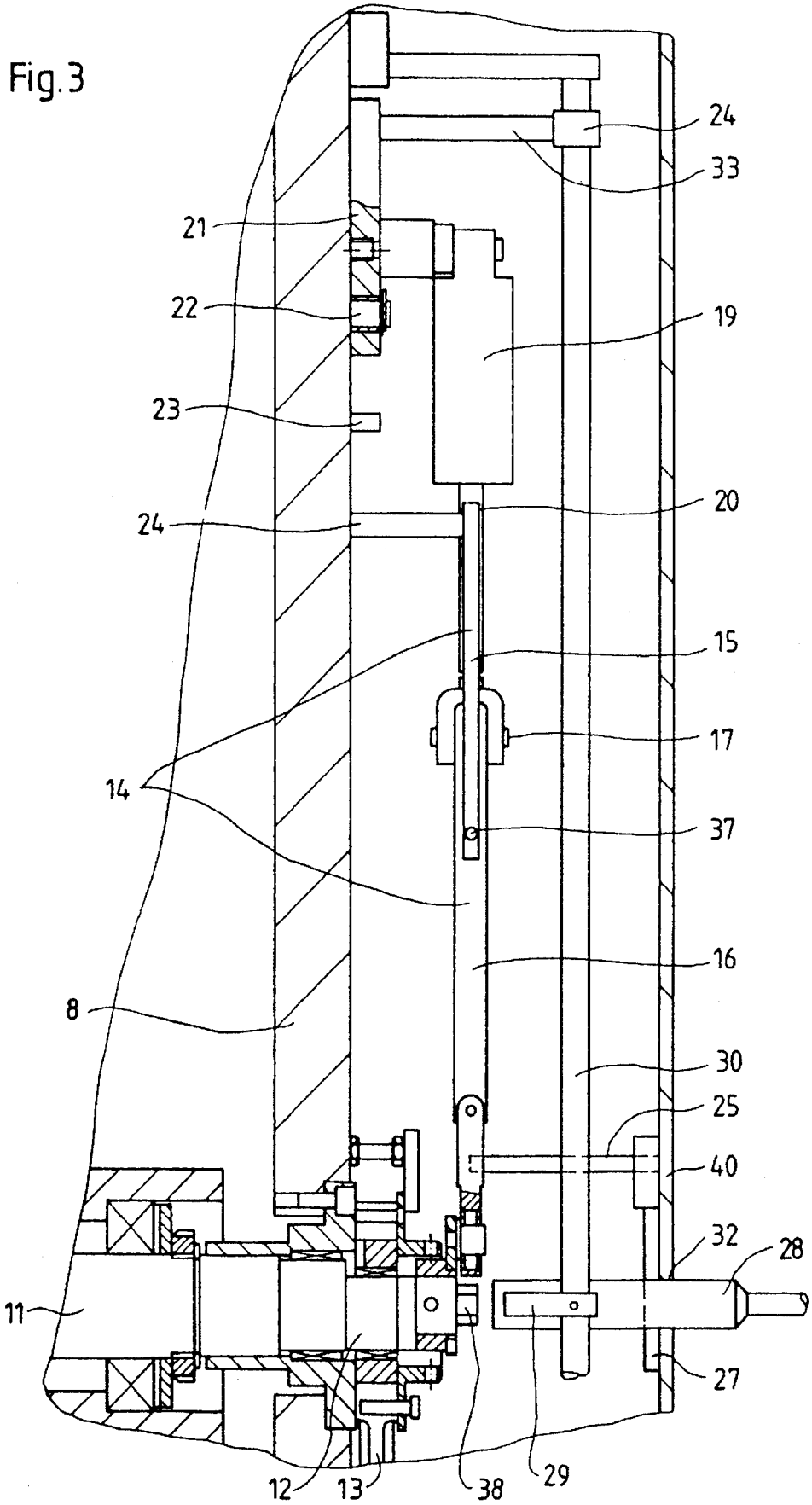
FIG. 3 is an enlarged cross-sectional view of the mechanism in accordance with the present invention.

In order for the printing unit 1 to reach the third position, wherein the printing unit 1 is uncoupled from the drive mechanism, the eccentric 12 will preferably be brought into the third position through an operator's tool 28 (see FIG. 3). For this adjustment through the operator's tool 28, a hexagonal bolt 38 located at an end of shaft 11 can be provided. After engaging the operator's tool 28 at the hexagonal bolt 38, the shaft 11 is rotatable clockwise, until the lever 16 movably supported on the eccentric 12 butts against a stop 25. The stop 25 is preferably arranged on a wall 40 of the frame 8, which wall is not shown in FIG. 2 in order that the mechanism described herein may be made visible (see FIG. 3). The eccentric 12 is preferably displaced past its dead point and, thus, butts securely against the stop 25. An unwanted displacement during machine operation or through vibration is therefore essentially impossible.

As the toggle lever mechanism 14 is connected at the toggle lever joint 17 with the piston rod 20 of the pneumatic cylinder 19, and the pneumatic cylinder 19 has only a limited adjustment path, it is essentially the case that, for the movement of the printing unit 1 into the third position, the pneumatic cylinder 19 is displaced. For this purpose, the pneumatic cylinder 19 is preferably mounted on a swivellable plate 21, which is attached to the frame 8 by means of a pivot 22. A stop 23 and a latch 24 preferably secure or arrest the swivellable plate 21, and thereby the pneumatic cylinder 19, in the first and in the second position of the printing unit 1. In order to reach the third position, the latch 24 is preferably swung aside, thereby releasing the swivellable plate 21, and the pneumatic cylinder 19 is essentially moved upward on account of its connection with the toggle lever mechanism 14, when movement into the third position is brought about by manual operation, as shown in the drawings. The release of the swivellabe plate 21 is preferably caused in that the operator's tool 28, when inserted into an insert opening 32 (see FIG. 3) of the wall 40, butts against an arm 29, thereby causing a control shaft 30 to rotate until the latch 24 connected with the control shaft 30 has released the swivellable plate 21.

Thus, in accordance with at least one preferred embodiment to the present invention, in order to realize the "third" position discussed further above, the plate cylinder 2 will preferably be movable into the third position solely upon the application of an operator's tool 28 onto a bolt 38, with subsequent rotation of the bolt 38. Preferably, the result will be the turning of eccentric 12 to such a degree that the bearing 39 displaced thereon is itself rotated sufficiently to bring a portion of lever 16 into contact with stop 25. In one embodiment of the present invention, with respect to FIG. 2, this engagement of lever 16 against stop 25 can conceivably be brought about via clockwise rotation of eccentric 12. Accordingly, to permit such extended rotation of eccentric 12, cylinder 19 will itself preferably be mounted on a swivellable plate 21 which itself is pivotably mounted, via pivot 22, on the frame 8. However, in order that the cylinder 19 may be held stationary in order to permit subsequent selective positioning of plate cylinder 2 through extension and retraction of piston rod 20, a latch 24 will preferably be provided to hold the swivellable plate 21, thus preventing any movement of cylinder 19 which would otherwise disrupt or alter accurate positioning of plate cylinder 2 into the aforementioned first and second positions. Conversely, with the latch 24 preferably being itself swivellably mounted, it will preferably be the case that, upon swiveling of latch 24 away from the position shown in FIG. 2, swivellable plate 21 will be free to pivot, thus, permitting eccentric 12 to be rotated to such an extent that lever 16 will eventually come in contact with stop 25. As discussed above, insertion of operator's tool 29 into opening 32 of wall 40 will preferably result in the operator's tool 28 pushing aside an arm 29, which arm 29, is preferably fixedly mounted to a control shaft 30 in such a manner that, upon such pushing away of arm 29, control shaft 30 will rotate to such an extent that latch 24 will pivot away from swivellable plate 21 and thus free swivellable plate 21 for subsequent movement. It is conceivable, within the scope of the present invention, to provide a spring-type arrangement that, upon subsequent removal of operator's tool 28 from bolt 38 and out of opening 32, the control shaft 30 will rotate back into the position illustrated in FIG. 2, with the arm 29 once again extending into the path of insertion of operator's tool Since it is desirable that the position of the plate cylinder 2 be maintained during uncoupling of the printing unit 1, a securing means is preferably provided. The securing means preferably has the function to make the gear wheels of the printing unit 1 engage in the gear wheel train of driving gear wheels et the same location, when the printing unit 1 is coupled anew to the printing press. Therefore, a fixing bolt 26 is preferably provided which is insertable into a bore of the plate cylinder 2. The fixing bolt 26 is preferably connected with the control shaft 30 via a gearing 36 and is preferably inserted with the insertion of the operator's tool 28 into the bore of the plate cylinder 2. In this way, it is essentially ensured that the uncoupling of the printing unit 1 can only be performed when the plate cylinder 2 is secured.

In accordance with at least one preferred embodiment of the present invention, the rotation of control shaft 30 affected by insertion of operator's tool 28, and pushing of arm 29, as discussed above, will also preferably cause gearing 36 to rotate, which will preferably be configured in such a manner as to affect the insertion of fixing bolts 26 into a bore of the plate cylinder 2. Preferably, this insertion could involve a simple axial displacement of fixing bolt 26, in a direction parallel to the rotational axis of plate cylinder 2. Conversely, upon removal of the operator's tool 28 and subsequent return rotation of control shaft 30, as discussed above, gearing 36 will also rotate in reverse and subsequently affect return axial displacement of fixing bolt 26. Although not specifically illustrated, the engagement of gearing 36 with fixing bolt 26 can be realized in any of a variety of suitable manners, such as in the manner of a worm and worm gear arrangement.

In order to remove the fixing bolt 26 again from the plate cylinder 2, a spring (not shown) is preferably provided. However, as the removal of the fixing bolt 26 can essentially only take place when the printing unit 1 has been coupled again to the drive mechanism, the mechanism described herein is preferably self-securing. Such self-securement is preferably effected via a securing bolt 33 which, upon realization of the aforementioned third position, contacts the latch 24 from underneath and holds the latch 24. This preferably takes place in the case of a displacement by way of the operator's tool 28. With such displacement, the bearing 39 of the lever 16 is essentially moved clockwise about an angle, so that the toggle lever mechanism 14, and therewith the pneumatic cylinder 19 swivel a distance far enough for the securing bolt 33 to reach the position of the latch 24 with a certain overshot, from where the toggle lever mechanism returns. The pivot angle about which the bearing 39 has been moved can preferably amount to little more than 100° in the exemplary embodiment. The securing bolt 33 is then preferably located under the latch 24 and preferably holds it, and thus also the control shaft 30 and the fixing bolt 26. The fixing bolt 26 is preferably held in a position for securing the plate cylinder 2 against the force of a spring.

Thus, via the above-described mechanism, the result is essentially that, when the printing unit 1 is placed into the third position, it remains in this position with the plate cylinder 2 being secured. The printing press can be operated with the printing unit 1 being uncoupled. For the recoupling of the printing unit 1, the operator's tool 28 is preferably inserted anew and the bearing 39 of the lever 16 is moved back into the position as illustrated, whereby, via the toggle lever mechanism 14 and the toggle lever Joint 17, the pneumatic cylinder 19, too, is moved back into the position as illustrated, wherein the swivellable plate 21 is butted against the stop 23. Then, as the operator's tool 28 is removed, a fixing-bolt spring preferably presses or pulls the fixing bolt 26 out of the bore of the plate cylinder 2 and, via the gearing 36, the control shaft 30 is preferably rotated into a position, wherein the latch 24 secures the swivellable plate 21 end swivels the arm 29 back into the insert path of the operator's tool 28. In this position of the control shaft 30, the printing unit 1, together with the plate cylinder 2, can be coupled again between the first two positions with the aid of the pneumatic cylinder 19. By inserting the operator's tool 28 anew, the releasing and securing is preferably brought about again in the above described manner, as the arm 29 is present again in the insert path to effect the self-securement upon insertion of the operator's tool 28.

FIG. 2 further shows limit switches 31 and 35 for detecting the various positions of the mechanism. The limit switches 31 and 35 serve to clear the printing press again for start-up, but only when one of the coupling processes is completed.

FIG. 3 shows an enlarged cross-sectional view of the mechanism, it being a left-side view with respect to FIG. 2. The reference numerals are identical for identical parts of the figures as mentioned above.

FIG. 3 represents a portion of the described mechanism in the third position of the printing unit 1, with the operator's tool 28 being inserted for moving the printing unit 1 back into the second position. FIG. 3 shows the wall 40 with the safety flap 27 for covering the insert opening 32 for the operator's tool 28 in positions in which no displacement can take place. In this way, it is ensured that the printing unit 1 and the additional printing unit 4, during coupling of the printing unit 1 are in a position wherein the registers of both printing units coincide. From FIG. 3, it can also be seen how the shaft 11 is centrally and rotatably mounted in the frame 8, and how, through rotation of the shaft 11 the eccentrics 12, together with the couples 13, effect an adjustment of the distance between the plate cylinder 2 and the blanket cylinder 3.

Hereinafter, the coupling processes are described in view of the exemplary embodiment presented hereinabove.

For separating the printing unit 1 from the printing press, the operator preferably pushes a button, whereby a control is actuated to cause the printing press to move into the position wherein the securing bolt 33 is insertable. Then, the safety flap 27 preferably opens and the operator can insert his tool 28. Thereby, the arm 29 is preferably pushed backward through the operator's tool 28, causing the control shaft to rotate about 90°. This has the result that the fixing bolt 26 is inserted into the plate cylinder 2 for securing the latter in its position. Simultaneously, the latch 24 can preferably move out of its securing position and release the swivellable plate 21, together with the pneumatic cylinder 19. The operator's tool 28 is now essentially engaged with the hexagonal bolt 38, and the shaft 11 can be rotated clockwise until the lever 16 butts against the stop 25. Through the rotation of the shaft 11, the eccentrics 12 will have been displaced beyond their dead point, and the distance between plate cylinder 2 and blanket cylinder 3 is in accordance with the uncoupled position of the printing unit 1. Thereby, the printing unit 1 has essentially made a swiveling movement about the pivot 6, so that the driving gear wheels of the printing unit 1 are not in engagement anymore with the gear wheel train of driving gear wheels of the printing press. The position is detected by the limit switch 35, causing the printing press to be cleared again for operation after the operator's tool 28 has been removed, but preferably only after the insert opening 32 has been closed by the safety flap 27.

The recoupling of the printing unit 1 is preferably performed as follower By pushing a button, a control is preferably actuated which causes the additional printing unit 4 to move into a position, wherein the register of the printing unit 4 corresponds with the register of printing unit 1. Preferably, only then does the safety flap 27 open and the operator's tool 28 be inserted into the insert opening 32. Now, the operator's tool 28 preferably is turned counterclockwise, until the swivellable plate 21 butts against the stop 23, whereby the toggle lever mechanism 14, together with the pneumatic cylinder 19 moves into the position illustrated in FIG. 2. This is preferably detected by the limit switch 35. As the operator's tool 28 is now removed, the fixing bolt 26 is preferably pulled out of the plate cylinder 2 by the force of the spring, as the operator's tool 28 clears the way for the arm 29 to swivel back. Simultaneously, the latch 24 is preferably moved into a position, wherein it secures the swivelable plate 21. The printing unit 1 is now preferably in a state of engagement again. After removal of the operator's tool 28, the safety flap 27 is preferably closed again and the printing press is cleared for start-up.

It is to be understood that the embodiments described above are exemplary only. The mechanism and the pneumatic cylinder could also be designed in a manner to enable all three positions to be taken in. Also, it is conceivable to provide another driving means and another mechanism for bringing the printing unit 1 into the three positions.

It will further be appreciated that the embodiments described herein can be utilized in printing presses having more than one printing unit, all of the more than one printing unit being assigned to a common, single blanket cylinder. Alternatively, the embodiments described herein could conceivably be utilized in conjunction with a single printing unit, having a single blanket cylinder, in which that entire portion of the printing unit from the plate cylinder and up would be removable from the blanket cylinder. In the case of more than one printing unit, it is conceivable that only one of the printing units be movable and the other be permanently stationary with respect to the blanket cylinder.

One feature of the invention resides broadly in the device for coupling a printing unit 1, 4, said printing unit 1, 4 being engaged with a blanket cylinder 3 in a first position and being disengaged from said blanket cylinder 3 in a second position, characterized in that the printing unit 1, 4 is placeable into a third position, wherein it is uncoupled from the drive mechanism.

Another feature of the invention resides broadly in the device characterized in that the plate cylinder 2 of the coupleable and uncoupleable printing unit 1 rotates around an axis 11 which is centrically and rotatably mounted in the frame 8 of the printing unit 1, that the axis 11, in its end regions, comprises eccentrics 12, that couples 13, being connected with the blanket cylinder 3, are mounted on the eccentric 12, and that to the three different positions of the printing unit 1 three different angular positions of the eccentrics 12 are assigned.

Yet another feature of the invention resides broadly in the device characterized in that the printing unit 1 is fastened to a machine frame 9, wherein the blanket cylinder 3 is mounted, by means of a pivot 6 arranged above the couples 13.

Still another feature of the invention resides broadly in the device characterized in that the eccentrics 12 are fixedly connected with the axis 11 and are displaceable by means of a common drive.

A further feature of the invention resides broadly in the device characterized in that the displacement of the eccentrics 12 is performed by means of a toggle lever mechanism 14.

Another feature of the invention resides broadly in the device characterized in that the drive is a pneumatic cylinder 19.

Yet another feature of the invention resides broadly in the device characterized in that the drive serves the engagement and disengagement of the plate cylinder 2 and the uncoupling of the printing unit 1 can be performed by manual operation.

Still another feature of the invention resides broadly in the device characterized in that the pneumatic cylinder 19 is swivelably hinged to the frame 8 of the printing unit 1, that said pneumatic cylinder 19 is locked for the coupling and uncoupling process, and that said locking securement is released when the manual operation is performed.

A further feature of the invention resides broadly in the device characterized in that through the manual operation for uncoupling the printing unit 1 the eccentrics 12 are displaced beyond a dead point, until the toggle lever mechanism 14 butte against a stop 25.

Another feature of the invention resides broadly in the device characterized in that the manual operation can only be performed in a position of the plate cylinder 2, wherein said plate cylinder 2 is secured against displacement.

Yet another feature of the invention resides broadly in the device characterized in that the securement of the plate cylinder 2 in the position for uncoupling or coupling the printing unit 1 takes place by means of a fixing bolt 26 being insertable into a bore of said plate cylinder 2.

Still another feature of the invention resides broadly in the device characterized in that on pressing a button a control is actuated to bring the printing unit 4 into a position for inserting the fixing bolt 26, and only in this position a safety flap 27 for inserting an operator's tool 28 is opened.

A further feature of the invention resides broadly in the device characterized in that by inserting the operator's tool 28 the insertion of the fixing bolt 26 and the release of the locking securement of the pneumatic cylinder 19 takes place.

Another feature of the invention resides broadly in the device characterized in that an arm 29 of a control shaft 30 extends into the insert path of the operator's tool 28, and the operator's tool 28, on its insertion, pushes the arm 29 aside, whereby the control shaft 30 is rotated causing the fixing bolt 26 to be inserted via a gearing 36, and the latch 24 to be swung out of its position of securing the pneumatic cylinder 19.

Yet another feature of the invention resides broadly in the device characterized in that through a rotary movement of the axis 11 by means of the operator's tool 28 the eccentrics are displaceable beyond the dead point and back again.

Still another feature of the invention resides broadly in the device characterized in that the completion of a displacement of the printing unit 1 into one of the positions is detected by limit switches 31, 35, whereby the printing press is cleared again for start-up.

A further feature of the invention resides broadly in the device characterized in that after one of the positions to which the printing unit can be displaced by means of the operator's tool 28 has been reached and said operator's tool 28 been removed, the insert opening 32 for the operator's tool 28 is closed again by a safety flap 27.

Another feature of the invention resides broadly in the device characterized in that a securing bolt 33 is fastened to a swivelable plate 21 by means of which the pneumatic cylinder 19 is swivelably hinged to the frame 8, said securing bolt 33 moving under the latch 24 while the latter is released, thereby holding the control shaft 30 in its position for uncoupling the printing unit 1.

Yet another feature of the invention resides broadly in the device characterized in that for the coupling of the uncoupled printing unit 1 the printing press, on pushing a button, is moved into a position, wherein the register of the printing press at large corresponds with the register of the printing unit 1 to be coupled, end only then the safety flap 27 opens itself.

Still another feature of the invention resides broadly in the device characterized in that for the uncoupling of the printing unit 1 by means of the inserted operator's tool 28 the eccentrics 12 are displaceable in a manner, whereby the toggle lever mechanism 14 moves into a position, wherein it causes the pneumatic cylinder 19 to be swivelled back into its secured position while the latch 24 is released through the securing bolt 33 and simultaneously causes the printing unit 1 to be connected to the drive.

A further feature of the invention resides broadly in the device characterized in that through removal of the operator's tool 28 the arm 29 with the control shaft 30 swings again into the insert path of the operator's tool 28 via a spring moving the fixing bolt 26 outward, and the latch 24 is moved again into its secured position through the swinging motion of the control shaft 30.

Another feature of the invention resides broadly in the device characterized in that a spring 10 is provided for supporting the displacement of the printing unit 1.

Examples of printing presses, and components thereof, which may be utilized in accordance with the embodiments of the present invention, may be found in the following U.S. Pat. No. 5,170,706, which issued to Rodi et al. on Dec. 15, 1992; U.S. Pat. No. 5,081,926, which issued to Rodi on Jan. 21, 1992; and U.S. Pat. No. 5,010,820, which issued to Loffler on Apr. 30, 1991.

Examples of spur gear arrangements, having components which may be utilized in accordance with the embodiments of the present invention, may be found in the following U.S. Pat. No. 4,552,067, which issued to Gollinger on Nov. 12, 1985; U.S. Pat. No. 4,137,845, which issued to Jeschke on Feb. 6, 1979; U.S. Pat. No. 4,154,165, which issued to Jeschke on May 15, 1979; and U.S. Pat. No. 4,321,869, which issued to Jeschke et al. on Mar. 30, 1982.

Examples of multi-unit printing presses, having components which may be utilized in accordance with the embodiments of the present invention, may be found in the following U.S. Patents: U.S. Pat. No. 5,161,463, which issued to Knauer et al. on Nov. 10, 1992; U.S. Pat. No. 4,991,505, which issued to D'Heureuse et al. on Feb. 12, 1991; and U.S. Pat. No. 5,142,981, which issued to Derringer et al. on Sep. 1, 1992.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the U.S. patents, recited herein, and in the Declaration foreign priority document attached hereto, are hereby incorporated by reference as if set forth in their entirety herein.

The corresponding foreign priority patent publication application, namely, Federal Republic of Germany Patent Application No. P 44 42 279.2, filed on Nov. 28, 1994, having inventors Bernd Herrmann and Hans-Jurgen Kusch, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed:

1. A device for coupling a printing unit to a printing stand in a printing press, said coupling device comprising: apparatus establishing:

a first position wherein a plate cylinder is engaged in contact with a blanket cylinder, and a plate cylinder drive mechanism is engaged with a printing stand drive mechanism;

a second position wherein a plate cylinder is disengaged out of contact with a blanket cylinder, and a plate cylinder drive mechanism is engaged with a printing stand drive mechanism; and a third position wherein a plate cylinder is disengaged out of contact with a blanket cylinder, and a plate cylinder drive mechanism is disengaged from a printing stand drive mechanism;

said apparatus comprising at least one eccentric;

said at least one eccentric comprising an arrangement for being rotatably mounted to an end of a plate cylinder shaft;

said at least one eccentric establishing:

a first angular position;

said first angular position corresponding to said first position;

a second angular position;

said second angular position corresponding to said second position;

a third angular position; and said third angular position corresponding to said third position;

said coupling device comprising at least one coupling element;

an end of said at least one coupling element being rotatably mounted on said at least one eccentric; and an opposite end of said at least one coupling element comprising an arrangement for being connected to the printing stand.

2. The coupling device according to claim 1, wherein the printing unit comprises: a plate cylinder shaft; the plate cylinder being concentrically mounted to the plate cylinder shaft; the plate cylinder shaft has an axis of rotation; a frame for mounting the plate cylinder; the plate cylinder shaft being rotatably mounted in the plate cylinder frame for allowing rotation of the plate cylinder in the plate cylinder frame;

said coupling device further comprises:

a pivot apparatus for fastening the printing unit to the printing stand;

said pivot apparatus being mounted at the printing stand;

the printing unit being pivotally mounted about said pivot apparatus;

said at least one eccentric has an axis of rotation;

the plate cylinder shaft axis of rotation being disposed a substantial distance from the at least one eccentric axis of rotation; and said at least one eccentric being disposed to revolve the plate cylinder shaft about the rotational axis of said at least one eccentric upon rotation of said at least one eccentric.

3. The coupling device according to claim 2, wherein:

said position establishing apparatus comprises drive apparatus for rotationally displacing said at least one eccentric;

said drive apparatus is disposed to engage and disengage the plate cylinder with the blanket cylinder;

said drive apparatus comprises a toggle lever mechanism;

said toggle lever mechanism comprises a toggle lever joint;

said toggle lever mechanism has a toggle action;

said toggle action has a dead point at which point a portion of said toggle lever mechanism reverses direction of movement;

the second angular position of said at least one eccentric being disposed between the first angular position of said at least one eccentric and the third angular position of said at least one eccentric;

said dead point comprises a fourth angular position of said at least one eccentric;

said fourth angular position being disposed between the second angular position of said at least one eccentric and the third angular position of said at least one eccentric;

said drive apparatus comprises an actuation device;

said actuation device comprises a piston apparatus;

said piston apparatus comprises a first end; and said piston apparatus comprises a second end.

4. The coupling device according to claim 3, wherein:

said first end of said piston apparatus being disposed a substantial distance from said second end of said piston apparatus;

said drive apparatus comprises a manually operated device;

said manually operated device being disposed to engage and disengage the plate cylinder drive mechanism with the printing stand drive mechanism;

said manually operated device comprises a plate;

said plate being pivotally mounted to the printing unit frame;

said first end of said piston apparatus being pivotally mounted to said plate;

said second end of said piston apparatus being pivotally mounted to said toggle lever joint;

said manually operated device comprises a locking apparatus;

said locking apparatus is disposed to pivotally lock said plate in a locked position upon engagement and disengagement of said plate cylinder with said blanket cylinder by said drive apparatus;

said locking apparatus is disposed to pivotally release said plate for pivotal displacement of said plate upon said manually operated device being actuated;

said manually operated device comprises a stop apparatus; and said stop apparatus is disposed to establish the third angular position of said at least one eccentric.

5. A printing press comprising:

a printing stand;

said printing stand comprising:

a blanket cylinder; and a drive mechanism for rotatably driving at least said blanket cylinder;

a printing unit;

said printing unit comprising:

a plate cylinder;

a drive mechanism for rotatably driving said plate cylinder; and said plate cylinder drive mechanism being selectively engageable with said printing stand drive mechanism for driving said plate cylinder;

a device for coupling said printing unit and said printing stand;

said coupling device being disposed to selectively position said printing unit with respect to said printing stand;

said coupling device comprising apparatus establishing:

a first position, wherein said plate cylinder is engaged in contact with said blanket cylinder and said plate cylinder drive mechanism is engaged with said printing stand drive mechanism;

a second position, wherein said plate cylinder is disengaged out of contact with said blanket cylinder and said plate cylinder drive mechanism is engaged with said printing stand drive mechanism;

a third position, wherein said plate cylinder is disengaged out of contact with said blanket cylinder and said plate cylinder drive mechanism is disengaged with said printing stand drive mechanism;

said printing unit further comprising:

a plate cylinder shaft;

said plate cylinder being concentrically mounted on said plate cylinder shaft;

a frame for mounting said plate cylinder; and said plate cylinder shaft being rotatably mounted in said plate cylinder frame for allowing rotation of said plate cylinder in said plate cylinder frame;

said position establishing apparatus comprising at least one eccentric;

said at least one eccentric being rotatably mounted to an end of said plate cylinder shaft;

said at least one eccentric establishing:

a first angular position;

said first angular position corresponding to said first position;

a second angular position;

said second angular position corresponding to said second position;

a third angular position; and said third angular position corresponding to said third position;

said coupling device comprising:

at least one coupling element;

an end of said at least one coupling element being rotatably mounted on said at least one eccentric; and an opposite end of said at least one coupling element being connected to said printing stand.

6. The printing press according to claim 5, wherein:

said printing stand comprises:

a printing stand frame;

said blanket cylinder being rotatably mounted in said printing stand frame;

said coupling device comprises:

a pivot apparatus for fastening said printing unit to said printing stand;

said pivot apparatus being mounted at said printing stand frame; and said printing unit being pivotally mounted about said pivot apparatus.

7. The printing press according to claim 6, wherein:

said plate cylinder shaft has an axis of rotation;

said at least one eccentric has an axis of rotation;

the shaft axis of rotation being disposed a substantial distance from said at least one eccentric axis of rotation;

said at least one eccentric being disposed to revolve said plate cylinder shaft about the rotational axis of said at least one eccentric upon rotation of said at least one eccentric; and said position establishing apparatus comprises a drive apparatus for rotationally displacing said at least one eccentric.

8. The printing press according to claim 7, wherein:

said drive apparatus is disposed to engage and disengage said plate cylinder with said blanket cylinder;

said drive apparatus comprises a toggle lever mechanism;

said toggle lever mechanism comprises a toggle lever joint;

said drive apparatus comprises an actuation device;

said actuation device comprises a piston apparatus;

said piston apparatus comprises a first end;

said piston apparatus comprises a second end;

said first end of said piston apparatus being disposed a substantial distance from said second end of said piston apparatus;

said drive apparatus comprises a manually operated device;

said manually operated device being disposed to engage and disengage said plate cylinder drive mechanism with said printing stand drive mechanism;

said manually operated device comprises a plate;

said plate being pivotally mounted to said printing unit frame;

said first end of said piston apparatus being pivotally mounted to said plate;

said second end of said piston apparatus being pivotally mounted to said toggle lever joint:

said manually operated device comprises a locking apparatus;

said locking apparatus is disposed to pivotally lock said plate in a locked position upon engagement and disengagement of said plate cylinder with said blanket cylinder by the drive apparatus; and said locking apparatus being disposed to pivotally release said plate for pivotal displacement of said plate upon said manually operated device being actuated.

9. The printing press according to claim 8, wherein said drive apparatus comprises a stop apparatus;

said stop apparatus being disposed to establish the third angular position of said at least one eccentric;

said toggle lever mechanism has a toggle action;

said toggle action has a dead point at which point a portion of said toggle lever mechanism reverses direction of movement;

the second angular position of said at least one eccentric being disposed between the first angular position of said at least one eccentric and the third angular position of said at least one eccentric;

said dead point comprises a fourth angular position of said at least one eccentric;

said fourth angular position being disposed between the second angular position of said at least one eccentric and the third angular position of said at least one eccentric;

said manually operated device comprises:

an apparatus being disposed to prevent actuation of said manually operated device when said plate cylinder is not secured against rotation;

an apparatus for securing said plate cylinder against rotation;

said apparatus for securing said plate cylinder comprises:

a fixing bolt;

a bore disposed in said plate cylinder;

said fixing bolt being insertable into said bore of said plate cylinder at a predetermined angular position of said plate cylinder; and a device for automatically positioning said plate cylinder to the predetermined angular position.

10. The printing press according to claim 9, wherein:

said manually operated device comprises a device for manual rotation of said at least one eccentric for engaging and disengaging said printing unit drive mechanism with said printing stand drive mechanism;

said manually operated device comprises an operator's tool;

said operator's tool being disposed to be engagable with said manual rotation device;

said apparatus for preventing actuation of said manually operated device comprises:

a safety flap apparatus;

said safety flap apparatus comprises an open position and a closed position;

said open position being disposed to allow said operator's tool to engage said manual rotation device;

said closed position being disposed to prevent said operator's tool from engaging said manual rotation device; and an apparatus being disposed to place said safety flap apparatus in the open position upon said plate cylinder being positioned in the predetermined angular position.

11. The printing press according to claim 10, wherein:

said locking apparatus comprises a control shaft;

said control shaft being rotatably mounted on said printing press;

said control shaft has an axis of rotation;

said printing press comprises a wall;

said wall comprises an insert opening;

said apparatus for preventing actuation of said manually operated device comprises:

said insert opening;

said insert opening being disposed to receive said operator's tool for actuation of said manually operated device;

said insert opening being disposed a substantial distance from said manual rotation device;

said operator's tool being disposed to have an insert path between said insert opening and said manual rotation device;

said locking apparatus comprises an arm;

said arm being fixedly connected to said control shaft;

said arm extending generally radially from said control shaft;

said arm being oriented generally perpendicular to the rotational axis of said control shaft;

said control shaft comprises a first angular position, wherein said arm is disposed to intrude into the insert path;

said control shaft comprises a second angular position, wherein said arm is disposed to be clear of the insertion path;

said arm being disposed to rotate said control shaft from the first angular position to the second angular position upon engagement of said operator's tool with said manual rotation device;

said control shaft comprises a latch;

said latch being disposed to pivotally lock and release said plate;

said latch being fixedly connected to said control shaft;

said latch extends generally radially from said control shaft;

said latch being oriented generally perpendicular to the rotational axis of said control shaft;

said latch comprises a first angular position and a second angular position;

the latch first angular position corresponds to the control shaft first angular position, wherein said latch is disposed to pivotally lock said plate;

the latch second angular position corresponds to the control shaft second angular position, wherein said latch is disposed to pivotally release said plate;

said apparatus for securing said plate cylinder comprises a device for inserting said fixing bolt upon engagement of said operator's tool with said manual rotation device;

said fixing bolt inserting device comprises:

said control shaft;

a gear apparatus;

a portion of said gear apparatus being non-rotatably connected to said control shaft;

said gear apparatus comprises a first angular position and a second angular position;

said gear apparatus first angular position corresponds to the control shaft first angular position, wherein said fixing bolt is removed from said plate cylinder bore; and said gear apparatus second angular position corresponds to the control shaft second angular position, wherein said fixing bolt is inserted into said plate cylinder bore.

12. The printing press according to claim 11, wherein:

said manual rotation device is rotatable from a first angular position to a second angular position;

said manual rotation device first angular position corresponds to the second position;

said manual rotation device second position corresponds to the third position;

the rotation of said manual rotation device from the manual rotation device first angular position to the manual rotation device second angular position passes a third angular position of said manual rotation device;

the manual rotation device third position corresponds to the fourth angular position of said at least one eccentric;

said manual rotation device is rotatable from the manual rotation device second angular position to the manual rotation device first angular position;

the rotation of said manual rotation device from the second angular position to the manual rotation device first position passes the third angular position of said manual rotation device.

13. The printing press according to claim 12, comprises:

an apparatus for clearing said printing press for start-up;

said printing press clearing apparatus comprises a detecting apparatus; and said detecting apparatus being disposed to detect at least one of:

the first position;

the second position; and the third position;

wherein said manually operated device comprises an apparatus for placing said safety flap apparatus in the closed position;

the safety flap apparatus closed position being disposed to obstruct said insert path;

said safety flap closing apparatus being actuated by:

one of a) and b):

a) actuation of said manually operated device, wherein said printing unit 1s displaced from the coupling device second position to the coupling device third position and removal of said operator's tool from said insert path; and b) actuation of said manually operated device, wherein said printing unit 1s displaced from the coupling device third position to the coupling device second position and removal of said operator's tool from said insert path.

14. The printing press according to claim 13, wherein:

said manually operating device comprises an apparatus for preventing rotation of said control shaft from the control shaft second angular position to the control shaft first angular position;

said control shaft preventing apparatus comprises a securing bolt;

said securing bolt being fastened to said plate; and said securing bolt being disposed to obstruct rotation of said latch from the latch second angular position to the latch first angular position upon operational pivoting of said plate.

15. The printing press according to claim 14, wherein:

said printing unit comprises a first registration;

said first registration corresponds to said plate cylinder predetermined position;

said printing press comprises a second registration;

the first registration is compatible with the second registration;

an apparatus for automatically positioning the printing press into the second registration; and said safety flap opening apparatus comprises said automatic positioning apparatus for placing said safety flap apparatus in the open position when the printing press is in the second registration position.

16. The printing press according to claim 15, wherein:

said plate comprises a first angular position;

said plate first angular position corresponds to the locked position of said plate;

said plate comprises a second angular position;

said plate second angular position corresponds to a released position of said plate;

said securing bolt comprises a first operating position and a second operating position;

said securing bolt first operating position corresponds to said plate first angular position, wherein said securing bolt is disposed to permit rotation of said latch about the control shaft axis of rotation;

said securing bolt second operating position corresponds to the plate second angular position, wherein said securing bolt is disposed to prevent rotation of said latch from the latch second angular position to the latch first angular position;

said drive apparatus comprises an apparatus for returning said plate from said plate second angular position to said plate first angular position upon manual engagement of said plate cylinder drive mechanism with said printing stand drive mechanism;

said plate returning apparatus comprises:

said toggle lever mechanism;

said at least one eccentric; and said piston apparatus;

said manually operated device comprises:

an apparatus for returning said control shaft from the control shaft second angular position to the control shaft first angular position upon removal of said operator's tool from the insert path;

said return apparatus comprises a spring apparatus;

said spring apparatus being disposed to exert a force on said fixing bolt;

said spring apparatus force being disposed to remove said fixing bolt from said plate cylinder bore;

a device to rotate said fixing bolt inserting device gear apparatus from the gear apparatus second angular position to the gear apparatus first angular position upon removal of said operator's tool from the insert path, whereby:

said control shaft is returned to the control shaft first angular position;

said latch is returned to the latch first angular position; and said arm is returned to the arm first angular position;

said coupling device comprises an additional spring apparatus;

said additional spring apparatus being disposed to provide a biasing force to said printing unit; and said biasing force being disposed to displace said printing unit.

17. A device for coupling a printing unit to a printing stand in a printing press, the printing unit comprising: a plate cylinder shaft; the plate cylinder being concentrically mounted to the plate cylinder shaft; the plate cylinder shaft having an axis of rotation; a frame for mounting the plate cylinder; the plate cylinder shaft being rotatably mounted in the plate cylinder frame for allowing rotation of the plate cylinder in the plate cylinder frame; and wherein:

said coupling device is disposed to selectively position a printing unit with respect to a printing stand;

said coupling device comprising:

means for establishing a first position for engaging a plate cylinder to make contact with a blanket cylinder, and for engaging a plate cylinder drive mechanism to engage with a printing stand drive mechanism;

means for establishing a second position for disengaging a plate cylinder to not contact a blanket cylinder, and for engaging a plate cylinder drive mechanism to engage with a printing stand drive mechanism; and means for establishing a third position for disengaging a plate cylinder to not contact a blanket cylinder, and for disengaging a plate cylinder drive mechanism from a printing stand drive mechanism;

said position establishing means comprising at least one eccentric;

said at least one eccentric being rotatably mounted to an end of the plate cylinder shaft;

said at least one eccentric establishing:

a first angular position;

said first angular position corresponding to said first position;

a second angular position;

said second angular position corresponding to said second position;

a third angular position; and said third angular position corresponding to said third position;

said at least one eccentric having an axis of rotation;

the shaft axis of rotation being disposed a substantial distance from the at least one eccentric axis of rotation;

said at least one eccentric being disposed to revolve the plate cylinder shaft about the rotational axis of said at least one eccentric upon rotation of said at least one eccentric;

said position establishing means comprising drive means for rotationally displacing said at least one eccentric;

said coupling device comprising at least one coupling element;

an end of said at least one coupling element being rotatably mounted on said at least one eccentric;

an opposite end of said at least one coupling element being connected to the printing stand;

said coupling device comprising pivot means for fastening the printing unit to the printing stand;

said pivot means being mounted at the printing stand; and the printing unit being pivotally mounted about said pivot means.

18. The coupling device according to claim 17, wherein:

said drive means is disposed to engage and disengage the plate cylinder with the blanket cylinder;

said drive means comprises toggle lever means;

said toggle lever means comprises:

a toggle lever joint;

said toggle lever means has a toggle action;

said toggle action has a dead point at which point a portion of said toggle lever means reverses direction of movement;

the second angular position of said at least one eccentric being disposed between the first angular position of said at least one eccentric and the third angular position of said at least one eccentric;

said dead point comprises a fourth angular position of said at least one eccentric;

said fourth angular position being disposed between the second angular position of said at least one eccentric and the third angular position of said at least one eccentric;

said drive means comprises actuation means;

said actuation means comprises piston means;

said piston means comprises a first end;

said piston means comprises a second end;

said first end of said piston means being disposed a substantial distance from said second end of said piston means;

said drive means comprises manually operated drive means;

said manually operated drive means being disposed to engage and disengage the plate cylinder drive mechanism with the printing stand drive mechanism;

said manually operated drive means comprises a plate;

said plate being pivotally mounted to the printing unit frame;

said first end of said piston means being pivotally mounted to said plate;

said second end of said piston means being pivotally mounted to said toggle lever joint;

said manually operated drive means comprises locking means;

said locking means comprising means for pivotally locking said plate in a locked position upon engagement and disengagement of said plate cylinder with said blanket cylinder by said drive means;

said locking means being disposed to pivotally release said plate for pivotal displacement of said plate upon said manually operated drive means being actuated;

said manually operated drive means comprises stop means; and said stop means for establing the third angular position of said at least one eccentric.

19. The coupling device according to claim 18, wherein the printing unit comprises a wall, and wherein:

said manually operated drive means comprises securing means;

said securing means comprises means for securing said plate cylinder against rotation;

said securing means comprises:

a fixing bolt;

a bore disposed in the plate cylinder; and said fixing bolt being insertable into said bore of the plate cylinder at a predetermined angular position of the plate cylinder;

said manually operated drive means comprises automatic positioning means;

said automatic positioning means comprises means for positioning the plate cylinder to the predetermined angular position;

said manually operated drive means comprises manual rotation means;

said manual rotation means comprises means for manual rotation of said at least one eccentric;

manual rotation of said at least one eccentric comprises means for engaging and disengaging the printing unit drive mechanism with the printing stand drive mechanism;

said manually operated drive means comprises an operator's tool;

said operator's tool being disposed to be engagable with said manual rotation means;

said manually operated drive means comprises means for preventing actuation of said manually operated drive means when the plate cylinder is not secured against rotation;

said actuation prevention means comprises safety flap means;

said safety flap means comprises an open position and a closed position;

said open position being disposed to allow said operator's tool to engage said manual rotation means;

said closed position being disposed to prevent said operator's tool from engaging said manual rotation means;

said actuation prevention means comprises means for placing said safety flap means in the open position upon the plate cylinder being positioned in the predetermined angular position;

said actuation preventing means comprises an insert opening;

said insert opening being disposed to receive said operator's tool for actuation of said manually operated drive means;

said insert opening being disposed a substantial distance from said manual rotation means;

said operator's tool being disposed to have an insert path between said insert opening and said manual rotation means;

the printing unit wall comprises said insert opening;

said locking means comprises a control shaft;

said control shaft has an axis of rotation;

said control shaft being rotatably mounted on the printing press;

said locking means comprises an arm;

said arm being fixedly connected to said control shaft;

said arm extending generally radially from said control shaft;

said arm being oriented generally perpendicular to the rotational axis of said control shaft;

said control shaft comprises a first angular position, wherein said arm is disposed to intrude into the insert path;

said control shaft comprises a second angular position, wherein said arm is disposed to be clear of the insertion path;

said arm being disposed to rotate said control shaft from the first angular position to the second angular position upon engagement of said operator's tool with said manual rotation means;

said control shaft comprises a latch;

said latch being disposed to pivotally lock and release said plate;

said latch being fixedly connected to said control shaft;

said latch extends generally radially from said control shaft;

said latch being oriented generally perpendicular to the rotational axis of said control shaft;

said latch comprises a first angular position and a second angular position;

the latch first angular position corresponds to the control shaft first angular position, wherein said latch is disposed to pivotally lock said plate;

the latch second angular position corresponds to the control shaft second angular position, wherein said latch is disposed to pivotally release said plate;

said plate cylinder securing means comprises means for inserting said fixing bolt upon engagement of said operator's tool with said manual rotation means;

said fixing bolt inserting means comprises:
said control shaft;
gear means;
a portion of said gear means being non-rotatably connected to said control shaft;
said gear means comprises a first angular position and a second angular position;
said gear means first angular position corresponds to the control shaft first angular position, wherein said fixing bolt is removed from said plate cylinder bore; and
said gear means second angular position corresponds to the control shaft second angular position, wherein said fixing bolt is inserted into said plate cylinder bore.

20. The coupling device according to claim 19, wherein the printing press comprises means for clearing the printing press for start-up; the printing unit comprises a first registration; the first registration correspond to the plate cylinder predetermined position; the printing press comprises a second registration; the first registration being compatible with the second registration; the printing press comprises means for automatically positioning the printing press into the second registration; and wherein:

said manual rotation means is rotatable from a first angular position to a second angular position;
said manual rotation means first angular position corresponds to the second position;
said manual rotation means second angular position corresponds to the third position;
the rotation of said manual rotation means from the manual rotation means first angular position to the manual rotation means second angular position passes a third angular position of said manual rotation means;
the manual rotation means third angular position corresponds to the fourth angular position of said at least one eccentric;
said manual rotation means is rotatable from the manual rotation means second angular position to the manual rotation means first angular position;
the rotation of said manual rotation means from the second angular position to the manual rotation means first position passes the third angular position of said manual rotation means;
said coupling device comprises detecting means;
said detecting means for detecting at least one of:
the first position;
the second position; and
the third position;
the printing press comprises said detecting means;
said manually operated drive means comprises means for placing said safety flap means in the closed position;
the safety flap means closed position comprises means for obstructing said insert path;
said safety flap closing means being actuated by:
one of a) and b):
a) actuation of said manually operated drive means, wherein said printing unit 1s displaced from the coupling device second position to the coupling device third position and removal of said operator's tool from said insert path;
b) actuation of said manually operated drive means, wherein said printing unit 1s displaced from the coupling device third position to the coupling device second position and removal of said operator's tool from said insert path;
said manually operated drive means comprises means for preventing rotation of said control shaft from the control shaft second angular position to the control shaft first angular position;
said control shaft preventing means comprises a securing bolt;
said securing bolt being fastened to said plate; and
said securing bolt being disposed to obstruct rotation of said latch from the latch second angular position to the latch first angular position upon operational pivoting of said plate;
said safety flap opening means comprises said automatic positioning means for placing said safety flap means in the open position when the printing press is in the second registration position;
said plate comprises a first angular position;
said plate first angular position corresponds to the locked position of said plate;
said plate comprises a second angular position;
said plate second angular position corresponds to a released position of said plate;
said securing bolt comprises a first operating position and a second operating position;
said securing bolt first operating position corresponds to said plate first angular position, wherein said securing bolt is disposed to permit rotation of said latch about the control shaft axis of rotation;
said securing bolt second operating position corresponding to the plate second angular position, wherein said securing bolt is disposed to prevent rotation of said latch from the latch second angular position to the latch first angular position;
said drive means comprises means for returning said plate from said plate second angular position to said plate first angular position upon manual engagement of said plate cylinder drive mechanism with said printing stand drive mechanism;
said plate returning means comprises:
said toggle lever means;
said at least one eccentric; and
means for returning means for returning said control shaft from the control shaft second angular position to the control shaft first angular position upon removal of said operator's tool from the insert path;
spring means;
said spring means comprises means for exerting a force on said fixing bolt;
said spring means comprises means for removing said fixing bolt from said plate cylinder bore;
means for rotating said gear means from the gear means second angular position to the gear means first angular position upon removal of said operator's tool from the insert path, whereby:
said control shaft is returned to the control shaft first angular position;
said latch is returned to the latch first angular position; and
said arm is returned to the arm first angular position;
said coupling device comprises additional spring means;
said additional spring means comprises means for providing a biasing force to the printing unit; and
said biasing force being disposed to displace the printing unit.

* * * * *

UNITED STATES PATENT AND TRADEMARK OFFICE

CERTIFICATE OF CORRECTION

PATENT NO. : 5,644,983

DATED : July 8, 1997

INVENTOR(S) : Bernd HERRMANN and Hans-Jürgen KUSCH

It is certified that error appears in the above-identified patent and that said Letters Patent is hereby corrected as shown below:

In column 5, line 36, after 'is', delete "e" and insert --a--.

In column 6, line 18, after 'through', delete "s" and insert --a--.

In column 7, line 1, after 'parts', delete "end" and insert --and--.

In column 9, line 7, after 'tool' insert --28.--.

In column 9, line 13, after 'wheels', delete "et" and insert --at--.

In column 11, line 9, after 'as', delete "follower" and insert --follows:--.

UNITED STATES PATENT AND TRADEMARK OFFICE

CERTIFICATE OF CORRECTION

PATENT NO. : 5,644,983

DATED : July 8, 1997

INVENTOR(S) : Bernd HERRMANN and Hans-Jürgen KUSCH

It is certified that error appears in the above-identified patent and that said Letters Patent is hereby corrected as shown below:

In column 12, line 28, after '14', delete "butte" and insert --butts--.

In column 13, line 17, after 'coupled,' delete "end" and insert --and--.

In column 20, line 33, Claim 13, after 'unit', delete "1s" and insert --is--.

In column 20, line 38, Claim 13, after 'unit', delete "1s" and insert --is--.

In column 25, line 59, Claim 20, after 'unit', delete "1s" and insert --is--.

UNITED STATES PATENT AND TRADEMARK OFFICE

CERTIFICATE OF CORRECTION

PATENT NO. : 5,644,983

DATED : July 8, 1997

INVENTOR(S) : Bernd HERRMANN and Hans-Jürgen KUSCH

It is certified that error appears in the above-identified patent and that said Letters Patent is hereby corrected as shown below:

In column 25, line 64, Claim 20, after 'unit', delete "ls" and insert --is--.

In column 26, Claim 20, after line 42 ("said at least one eccentric; and"), insert the following new line:

--said piston means;--.

In column 26, line 43, Claim 20, after the first occurrence of 'returning' delete "means for returning".

In column 23, line 32, Claim 18, after 'for', delete "establing" and insert --establishing--.

Signed and Sealed this

Twenty-second Day of September, 1998

*Attest:*

Bruce Lehman

BRUCE LEHMAN

*Attesting Officer*

*Commissioner of Patents and Trademarks*